US009518743B2

(12) United States Patent
Eroglu

(10) Patent No.: US 9,518,743 B2
(45) Date of Patent: Dec. 13, 2016

(54) METHOD FOR OPERATING A GAS TURBINE BURNER WITH A SWIRL GENERATOR

(71) Applicant: ALSTOM Technology Ltd, Baden (CH)

(72) Inventor: Adnan Eroglu, Untersiggenthal (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 290 days.

(21) Appl. No.: 14/074,292

(22) Filed: Nov. 7, 2013

(65) Prior Publication Data

US 2014/0123670 A1 May 8, 2014

Related U.S. Application Data

(62) Division of application No. 12/684,187, filed on Jan. 8, 2010, now Pat. No. 8,601,818.

(30) Foreign Application Priority Data

Jan. 15, 2009 (EP) ..... 09150601

(51) Int. Cl.
*F23R 3/34* (2006.01)
*F23R 3/36* (2006.01)
(Continued)

(52) U.S. Cl.
CPC ..... *F23R 3/34* (2013.01); *F23C 6/047* (2013.01); *F23D 11/105* (2013.01); *F23D 11/12* (2013.01); *F23D 11/402* (2013.01); *F23D 14/58* (2013.01); *F23D 14/64* (2013.01); *F23D 17/002* (2013.01); *F23R 3/12* (2013.01); *F23R 3/286* (2013.01); *F23R 3/343* (2013.01); *F23R 3/346* (2013.01); *F23R 3/36* (2013.01); *F23C 2900/07002* (2013.01); *F23C 2900/07021* (2013.01);
(Continued)

(58) Field of Classification Search
CPC ..... F23R 2900/03341; F23R 2900/07002; F23R 3/34
See application file for complete search history.

(56) References Cited

U.S. PATENT DOCUMENTS 7,810,336 B2 * 10/2010 Moraes ..... F02C 7/22 60/740
2002/0142257 A1 * 10/2002 Eroglu ..... F02C 9/28 431/12

(Continued)

*Primary Examiner* — Gerald L Sung
*Assistant Examiner* — Scott Walthour
(74) *Attorney, Agent, or Firm* — Buchanan Ingersoll & Rooney PC

(57) ABSTRACT

Methods are directed to operating a burner of a gas turbine. The burner includes a swirl generator and, downstream of it, a mixing tube. The swirl generator is defined by at least two walls facing one another to define a conical swirl chamber and includes nozzles arranged to inject fuel and apertures arranged to feed an oxidizer into the swirl chamber. The burner includes a lance which extends along a longitudinal axis of the swirl generator and side nozzles for ejecting a fuel within the burner. The side nozzles have their axes inclined with respect to the axis of the lance and can be positioned along the axis of the burner. During operation, an oil fuel or gaseous fuel is injected into to the burner through the lance tip and the lance side nozzles at various percentages depending on an operating mode of the gas turbine.

9 Claims, 6 Drawing Sheets

(51) Int. Cl.

| | |
|---|---|
| ***F23C 6/04*** | (2006.01) |
| ***F23D 11/10*** | (2006.01) |
| ***F23D 11/12*** | (2006.01) |
| ***F23D 11/40*** | (2006.01) |
| ***F23D 14/58*** | (2006.01) |
| ***F23D 14/64*** | (2006.01) |
| ***F23D 17/00*** | (2006.01) |
| ***F23R 3/12*** | (2006.01) |
| ***F23R 3/28*** | (2006.01) |

(52) U.S. Cl.
CPC ..... *F23D 2900/00015* (2013.01); *F23D 2900/11101* (2013.01); *F23R 2900/03341* (2013.01)

(56) References Cited

U.S. PATENT DOCUMENTS

| | | | | |
|---|---|---|---|---|
| 2003/0152880 | A1* | 8/2003 | Eroglu | F23C 7/002 431/8 |
| 2006/0183069 | A1 | 8/2006 | Bernero et al. | |
| 2007/0207431 | A1 | 9/2007 | Oomens et al. | |
| 2007/0231762 | A1* | 10/2007 | Bernero | F23D 11/107 431/350 |
| 2008/0115497 | A1 | 5/2008 | Eroglu et al. | |
| 2008/0173005 | A1 | 7/2008 | Althaus | |

* cited by examiner

METHOD FOR OPERATING A GAS TURBINE BURNER WITH A SWIRL GENERATOR

This application is a divisional of U.S. patent application Ser. No. 12/684,187 filed on Jan. 8, 2010 and claiming claims priority under 35 U.S.C. §119 to European application no. 09150601.4, filed 15 Jan. 2009, the entirety of which is incorporated by reference herein.

BACKGROUND

1. Field of Endeavor

The present invention relates to a burner of a gas turbine; the invention also refers to a method for operating such a burner.

2. Brief Description of the Related Art

In particular, the present invention relates to a sequential combustion gas turbine, which includes a compressor for compressing a main air flow, a first burner for mixing a first fuel with the main air flow and generating a first mixture which is then combusted, a high pressure turbine where the combusted gasses are expanded, a second burner where a second fuel is injected into the gasses already expanded in the high pressure turbine to generate a second mixture which is then combusted, and a low pressure turbine where also these combusted gasses are expanded and are then discharged.

Specifically, a burner embodying principles of the present invention is the first burner of the sequential combustion gas turbine.

During normal operation gas turbines are typically fed with a gaseous fuel which is mixed with the air to generate the mixture to be combusted.

Nevertheless, for some reasons, such as interruptions of the gas service or gaseous fuel compressor problems, the gas may not be available for feeding the gas turbines.

For this reason, in order to prevent gas turbines from being stopped (they are usually used for electric power generation), gas turbines are also able to operate with a liquid fuel, such as oil, and can switch from gaseous fuel to liquid fuel, and vice versa, on-line.

U.S. Pat. No. 7,003,960 discloses a burner having a conical swirl generator provided at its lateral walls with apertures for tangentially feeding air and nozzles for injecting a gaseous fuel; this burner is also provided with a central lance for injecting a liquid fuel. In particular the lance is provided with a nozzle at its tip arranged to generate a conically propagating cloud of fuel within the swirl generator.

A further burner is disclosed in WO 03056241, which describes a burner with a conical swirl generator and downstream of it a mixing tube. The lateral walls of the conical swirl generator are provided with apertures for tangentially feeding air and nozzles for injecting a gaseous fuel. In addition, this burner has a lance which projects along its axis and is provided with nozzles at its lateral wall that are able to radially inject (i.e., in a direction perpendicular to the axis of the lance) a fuel.

The traditional burners described let low emissions be achieved and have the capability of being adapted to changes in ambient, fuel, and engine conditions, in particular at full load.

Nevertheless, during operation with liquid fuel (i.e. oil), burners must be fed with a mixture of oil and water (which is prepared upstream of the gas turbine) in order to prevent auto ignition of the droplets as soon as they go out from the nozzles.

Auto ignition would cause the liquid fuel droplets to burn in a zone of the burner close to the nozzles, where the droplets do not have enough air to correctly burn and before they have time to propagate towards zones richer in air. Thus auto ignition (with consequent combustion in an ambient poor of air) would cause high NOx emissions.

Water to be mixed with the liquid fuel must be previously purified and demineralised; this requires adapted plants and substantially involves high costs, in particular in regions (such as the Gulf region) where water is lacking.

In addition, existing burners have shown an operation that is not optimal, due to a poor and a not adaptable mixing quality of the fuel (both gaseous and liquid fuel) with the air.

The unadaptable mixing quality makes the burners unable to create (at partial and low load) a fuel rich central zone; this causes (at partial and low load) unstable flame, pulsations and low extinction limit.

In addition, poor mixing quality makes the NOx emissions increase at high load.

SUMMARY

One of numerous aspects of the present invention includes a burner and a method by which problems of the known art are eliminated.

Another aspect includes a burner able to operate with dry liquid fuel or with mixtures of liquid fuel and water containing a low or very low percentage of water.

Yet another aspect includes a burner that permits the mixing quality to be improved and optimized at partial/low load.

Improved mixing quality permits flame stability and the extinction limit to be increased and pulsation to be reduced.

Another aspect includes a burner that permits NOx emissions to be reduced.

BRIEF DESCRIPTION OF THE DRAWINGS

Further characteristics and advantages of the invention will be more apparent from the description of a preferred, but non-exclusive, embodiment of a burner embodying principles of the present invention, illustrated by way of non-limiting example in the accompanying drawings, in which.

DETAILED DESCRIPTION OF EXEMPLARY EMBODIMENTS

Figure 8:
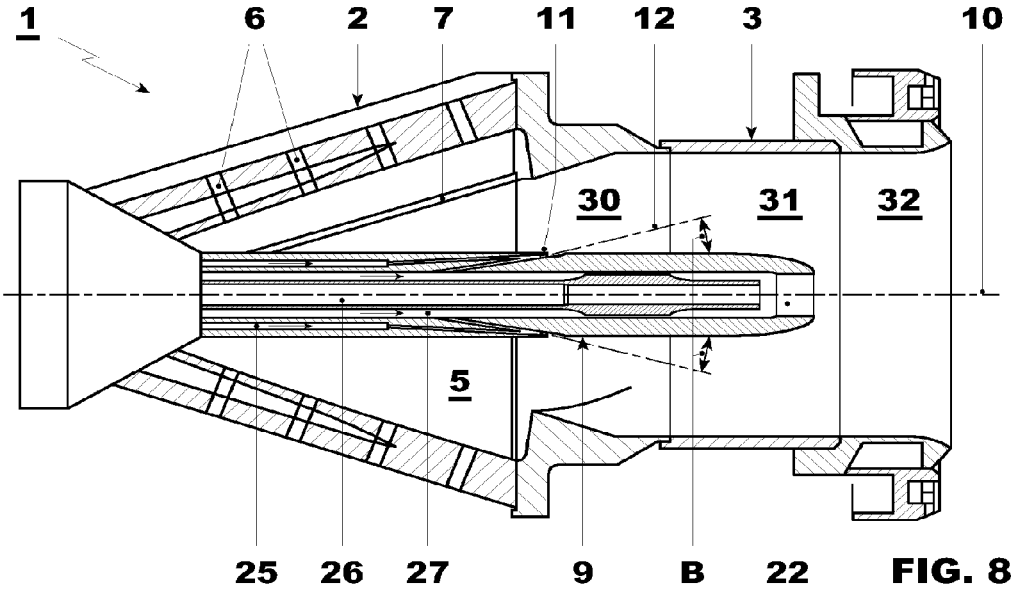
FIG. 8 shows a schematic view of an embodiment of the burner in accordance with the invention with a lance extending within a mixing tube.

With particular reference to FIG. 8, the figure shows a burner of a gas turbine overall indicate by the reference 1; this burner is the first burner of a sequential gas turbine.

The burner 1 includes a swirl generator 2 and downstream of it a mixing tube 3.

The swirl generator 2 is defined by at least two conical walls facing one another to define a substantially conical swirl chamber 5.

Moreover, the walls of the swirl generator 2 are provided with nozzles 6 arranged to inject a gaseous fuel and apertures 7 arranged to feed an oxidizer (typically compressed air coming from the compressor) into the swirl chamber 5.

The burner 1 also includes a lance 9 which extends along a longitudinal axis 10 of the swirl generator 1 and is of retractable type, i.e. it may be removed without the need of disassembling the swirl generator for replacement or maintenance.

The lance 9 is provided with side nozzles 11 for ejecting a liquid or gaseous fuel within the burner.

The side nozzles 11 are placed on a lateral wall of the lance 9 and have their axes 12 inclined with respect to the axis of the lance 9 (the axis of the lance 9 overlaps the axis of the burner 10).

Preferably, the axes 12 of the side nozzles 11 are tilted less than 30° with respect to the axis of the lance 9 (which overlaps the axis 10).

Moreover, the nozzles 11 are able to inject gaseous fuel, liquid fuel and a flow of shielding air encircling the fuel during injection.

The side nozzles 11 are placed in a part of the lance 9 which is housed within the mixing tube 3.

Figure 2:
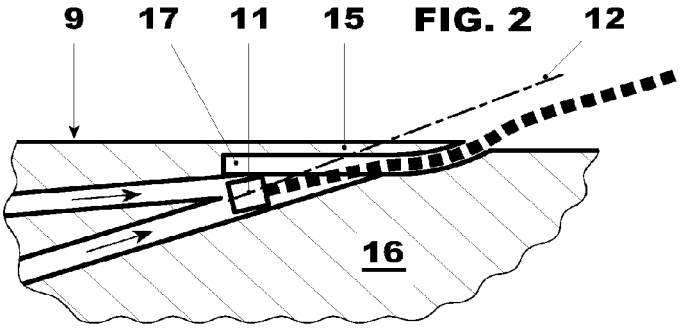
FIGS. 2-4 show details of the zone of the nozzles at the lateral wall of the lance in the first embodiment.
Figure 3:
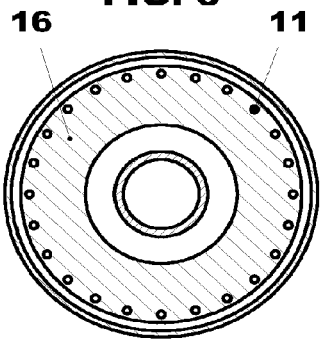
Figure 4:
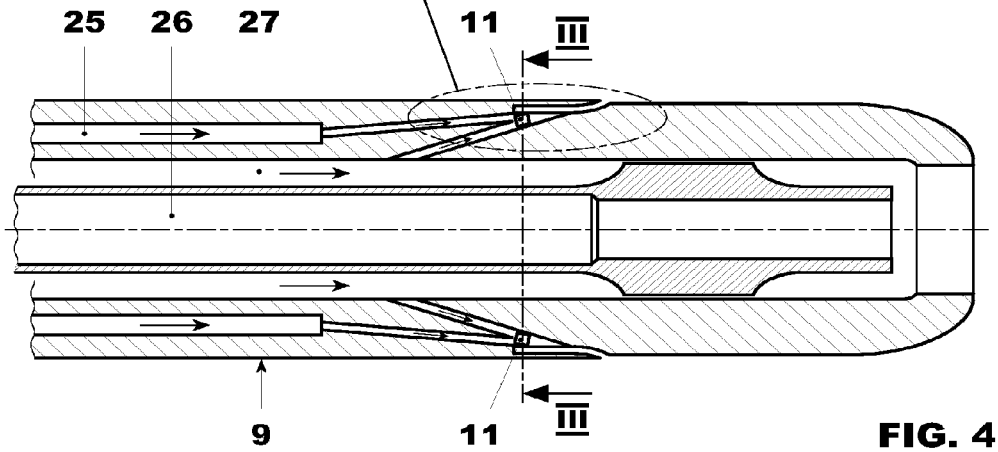

FIGS. 2-4 show a first disposition of the side nozzles 11 on the lance 9.

In this first disposition, the lance 9 includes an annular lid 15 encircling a body 16 of the lance 9 and defining with it an annular slit 17.

All of the side nozzles 11 open in the annular slit 17 and have their axes 12 towards the annular lid 15.

This disposition of the side nozzles 11 let the fuel, after injection, hit the lid 15 to generate a cylindrical fuel film encircling the lance 9.

Figure 5:
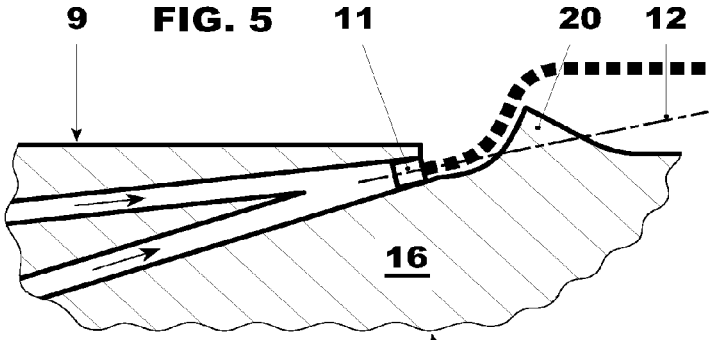
FIGS. 5-7 show a particular of the zone of the nozzles at the lateral wall of the lance in a second embodiment.
Figure 6:
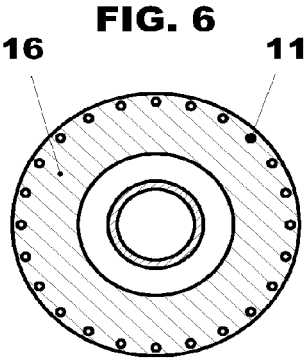
Figure 7:
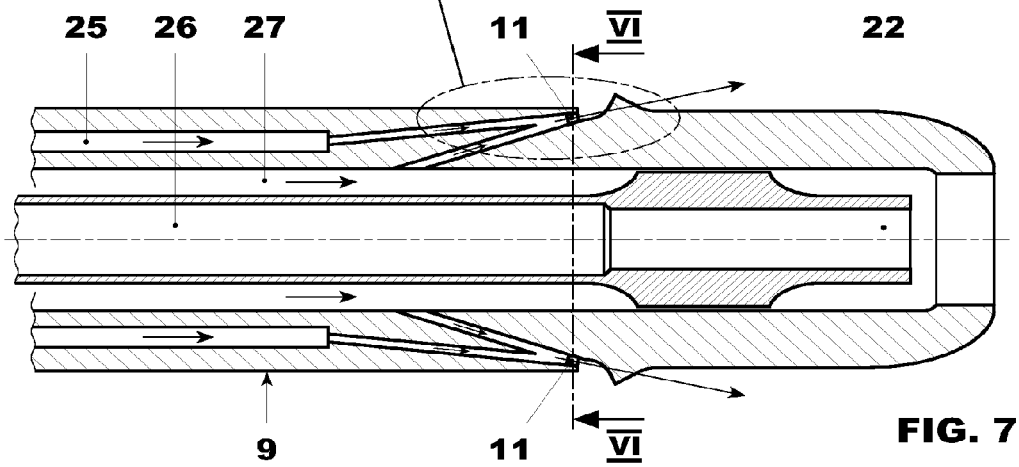

FIGS. 5-7 show a second disposition of the side nozzles 11 on the lance 9.

In this second disposition the lance 9 has a protrusion 20, for instance made of an annular lip encircling the body 16.

The side nozzles 11 open directly within the swirl chamber 5 or mixing tube 3 and have their axes 12 towards the protrusion 20.

With this disposition of the side nozzles 11, when the fuel is injected, it hits the protrusion 20 and generates a plurality of fuel flows around the lance 9; these fuel flows constitute a discrete fuel film encircling the lance 9.

Both dispositions let a plurality of side nozzles 11 be provided, this assures pre-distribution of the fuel (this is particularly important for oil).

Moreover, thanks to their large number, the side nozzles 11 have holes of small size (0.5 to 1.5 millimeters) to inject a small flow of fuel.

These features let the atomnisation, evaporation and mixing times of the fuel be shortened.

In addition, the lance 9 also includes one or more nozzles 22 at its tip to inject further fuel; preferably the tip of the lance has one nozzle 22 which is equipped with either a swirl atomizer or a multi-hole injector. Also the nozzle 22 is able to inject gaseous fuel, liquid fuel, and a flow of shielding air encircling the fuel during injection.

The lance 9 houses first pipes 25 for feeding the side nozzles 11 with a gaseous or liquid fuel and one or more second pipes 26 for feeding the tip nozzle 22 with a gaseous or liquid fuel; the first and the second pipes 25, 26 are independently operable.

In addition, the lance 9 also houses one or more pipes 27 for supplying air to both the side nozzles 11 and the tip nozzle 22.

FIG. 8 show a plurality of first pipes 25 each supplying one of the side nozzles 11; alternatively the lance 9 may also include one single annular first pipe 25 or two or more first pipes 25 each supplying two or more nozzles 11.

FIG. 8 shows a lance 9 with a single tip nozzle 22 and, in this respect, it only shows a single second pipe 26 centrally placed in the lance 9 (along the axis of the lance). Further embodiments are naturally possible, for instance the lance 9 may have two or more tip nozzles 22 and may include a single pipe 26 feeding all of the nozzles 22, a plurality of pipes 26, each feeding a tip nozzle 22, or two or more pipes 26, each feeding two or more tip nozzles 22.

The lance 9 may also include one or more pipes 27 feeding one or more nozzles 11 and/or one or more nozzles 22.

With reference to FIG. 8, the mixing tube 3 has an inlet diffusion zone 30, an intermediate cylindrical zone 31, and an outlet zone 32 which is also substantially cylindrical.

The side nozzles 11 are located on the lance 9 at the inlet diffusion zone 30 and the tip of the lance 9 extends up to the intermediate cylindrical zone 31.

Figure 9:
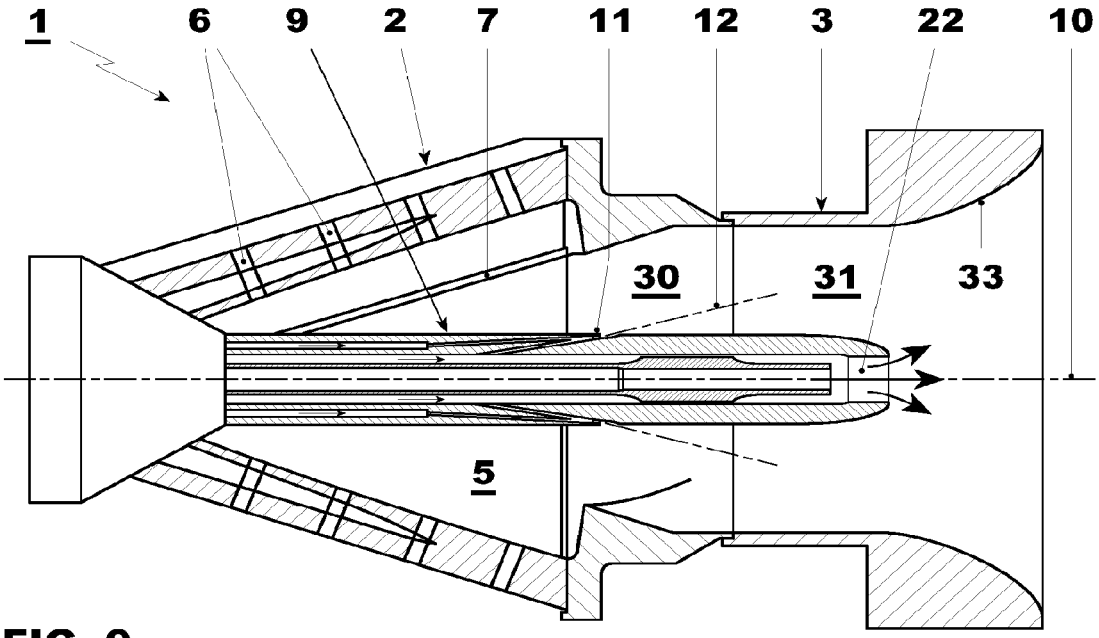
FIG. 9 shows a schematic view of an embodiment of the burner in accordance with the invention similar to that of FIG. 8, and further having an end diffusion portion at the outlet of the mixing tube.

FIG. 9 shows a different embodiment of the burner embodying principles of the present invention.

This burner has the same features already described for the burner of FIG. 8 and in this respect similar elements are indicated by the same references.

In addition, the burner of FIG. 9 has the mixing tube 3 with an end diffusion portion 33; the lance 9 projects in the mixing tube 3 such that its tip is located at the end diffusion portion 33.

Figure 10:
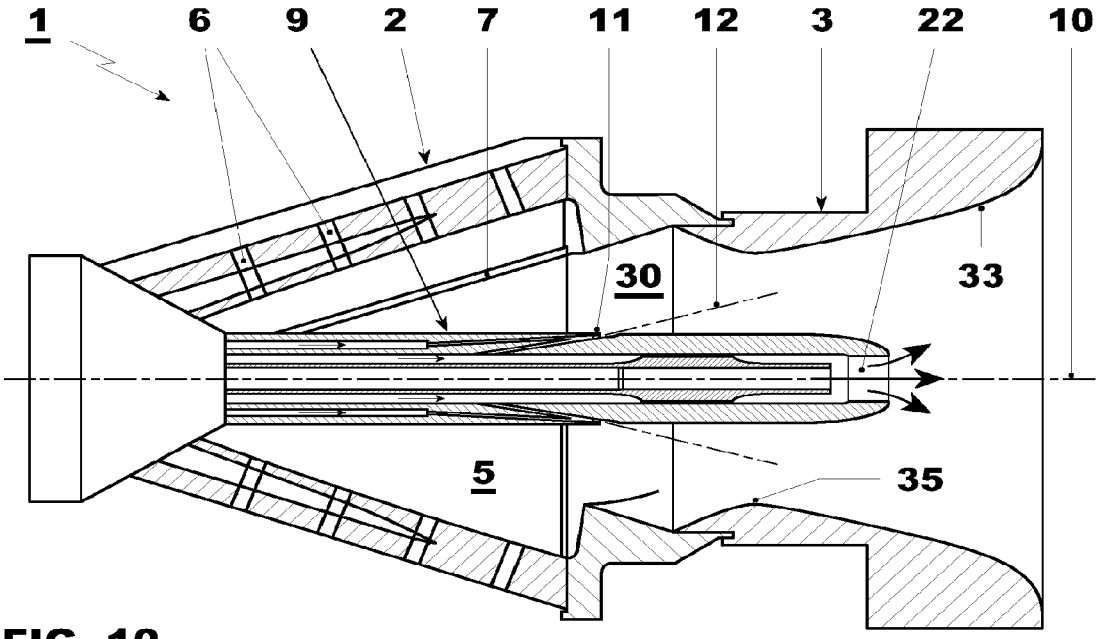
FIG. 10 shows a schematic view of an embodiment of the burner in accordance with the invention similar to that of FIG. 9, and further having a contraction in an intermediate zone of the mixing tube.

FIG. 10 shows a further embodiment of the burner embodying principles of the present invention.

Also this embodiment has the same features already described for the burner of FIGS. 8 and 9 and similar elements are indicated by the same reference numerals.

In addition, the mixing tube 3 of this burner defines a contraction 35 in an intermediate zone between the inlet diffusion zone 30 and the end diffusion portion 33.

In particular, the contraction 35 is provided between the tip of the lance 9 and the region of the lance provided with the side nozzles 11.

The nozzles 6 placed on the walls of the swirl generator 2 may be either all simultaneously operable or may be divided in two or more independently operable nozzle groups.

In the first case all of the nozzles are fed by one single feeding circuit.

In the second case there are provided two or more feeding circuits (a feeding circuit for each of the nozzle groups) that are operated independently of each other.

Moreover, a first group of nozzles is preferably located upstream of a second group of nozzles, even if they may have portions facing one another.

Figure 1:
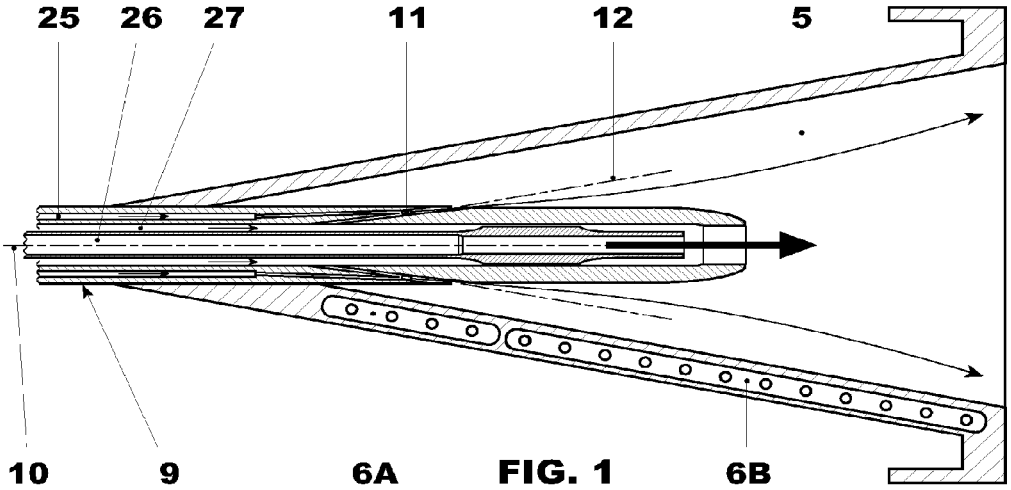
FIG. 1 is a schematic view of a first embodiment of the burner in accordance with the invention.

FIG. 1 shows a different embodiment of the invention.

In this embodiment the conical walls of the swirl generator 2 have two groups of nozzles, the first group 6A and, downstream thereof, the second group 6B; the walls of the swirl generator 2 also have the apertures for tangentially supply air.

The lance 9 (which has the same features already described for the other embodiments) extends along the longitudinal axis 10 of the conical combustion chamber 5 but, unlike all of the other embodiments described above, does not overcome the swirl generator 2 to enter the mixing tube 3.

In other words, the lance 9 is fully housed within the swirl generator 2 and the side nozzles 11 are positioned in a part of the lance which is housed within the swirl generator; in particular the side nozzles 11 are at the first group of nozzles 6A while the tip of the lance 9 is at the second group of nozzles 6B.

The operation of burners embodying principles of the present invention is apparent from that described and illustrated and is substantially the following.

All of the embodiments described may alternatively operate with gaseous fuel and liquid fuel; in the following, for sake of clarity, operation with liquid fuel will be described with reference to FIGS. 9 and 10, and operation with gaseous fuel will be described with reference to FIGS. 11-13.

Operation with Liquid Fuel

With reference to FIG. 9, the fuel is only injected through the nozzles 11, 22 of the lance 9.

Thus, compressed air enters the swirl chamber 5 through the apertures 7 and, thanks to the configuration of the swirl chamber 5, starts to rotate with high vorticity towards the mixing tube 3.

The side nozzles 11 inject the fuel (in an amount according to the operation stage) in a region where a great vorticity exists; this vorticity promotes fuel atomization and mixing with air.

The vorticity is characterized by high centrifugal forces that let the fuel (that is injected from the lance 9) uniformly distribute in the mixing tube.

Moreover, as the fuel is injected along a direction at an angle to the axis of the burner, the risk that it hits the walls of the swirl generator 2 or the mixing tube 3, is reduced.

Experimental tests showed that when the fuel is injected along a direction tilted less than 30° from the axis of the lance, an optimal oil distribution is achieved at the exit of the burner and mixing is optimized.

In fact, the oil droplets, as soon as they are injected, are dragged away by the very high vorticity and turbulence and are distributed in an annular region close to the walls of the swirl chamber and mixing tube; therefore there is no risk that the oil droplets that contain small percentages of water or no water at all, will start to burn immediately when they go out from the side nozzles and before they have enough time to mix with the air.

In addition, the improved mixing quality with respect to the traditional burners let the pulsation and NOx emissions be reduced.

Moreover, further fuel is injected through the tip nozzle 22 along the axis of the burner.

This further fuel generates a cloud of fuel droplets concentrated along the axis of the burner.

For example:

at starting, 80% of the oil is injected through the tip nozzles 22 and only 20% is injected through the side nozzles 11;

at idle operation, 75% of the oil is injected through the tip nozzles 22 and 25% is injected through the side nozzles 11;

at part load, 50% of the oil is injected through the tip nozzles 22 and 50% is injected through the side nozzles 11;

at full load, only 10% of the oil is injected through the tip nozzles 22 and 90% is injected through the side nozzles 11.

The operation of the burner of FIG. 10 is the same as that already described; in this embodiment, the contraction 35 increases the velocity of the air flow after fuel injection in order to reduce flashback risks.

Operation with Gaseous Fuel

During operation with gaseous fuel the side nozzles 11 may be active or inactive.

Figure 13:
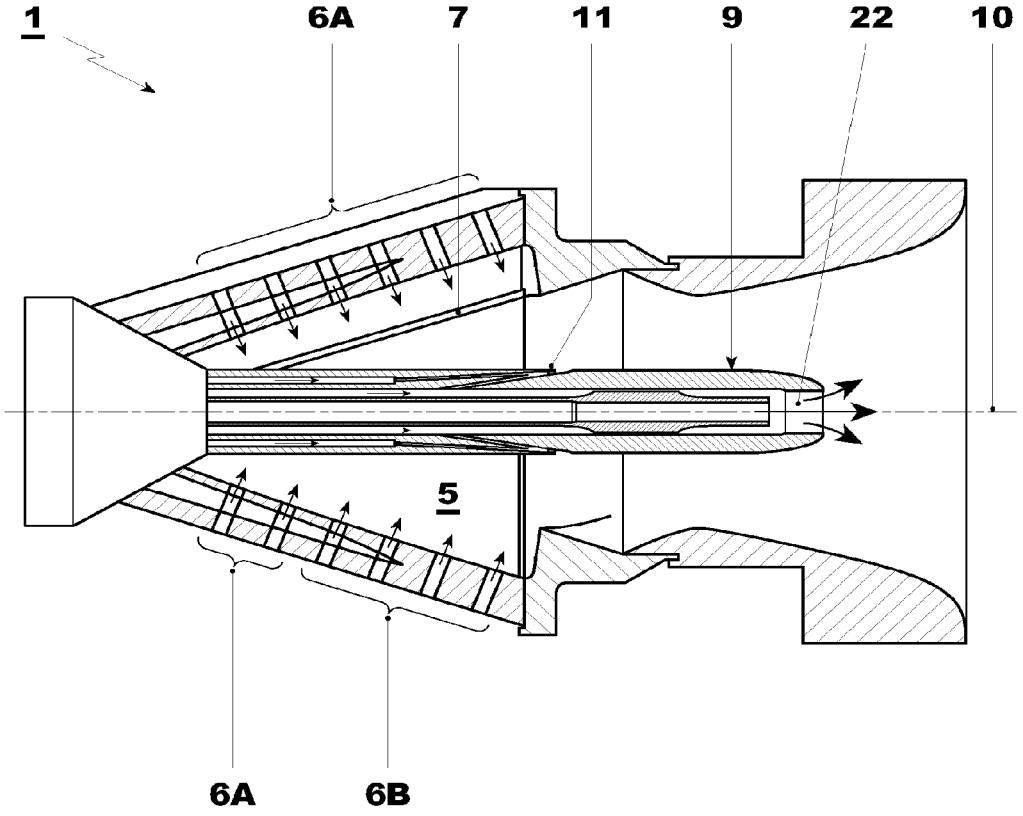
FIG. 13 shows a schematic view of a further embodiment similar to that of FIG. 10 and further having injection from the nozzles at the walls of the swirl generator in two stages.
Figure 14:
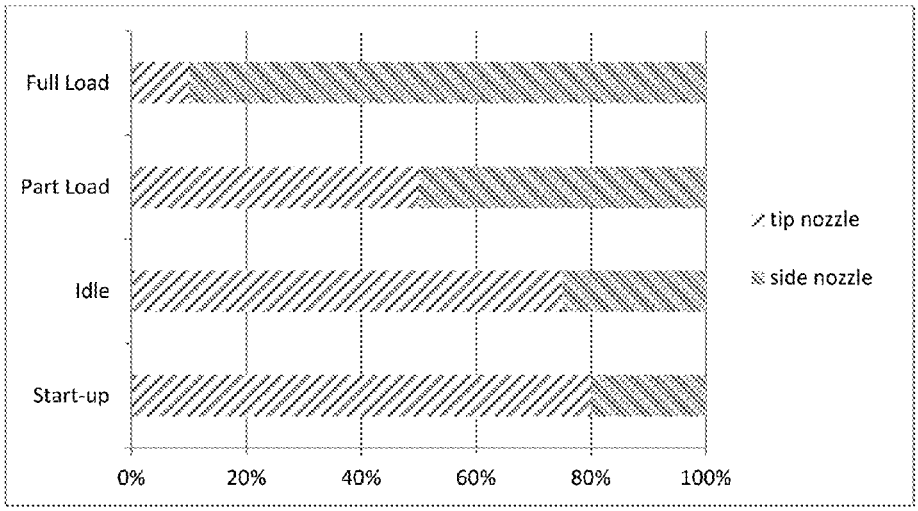
FIG. 14 shows an example of operation with liquid fuel.
Figure 15:
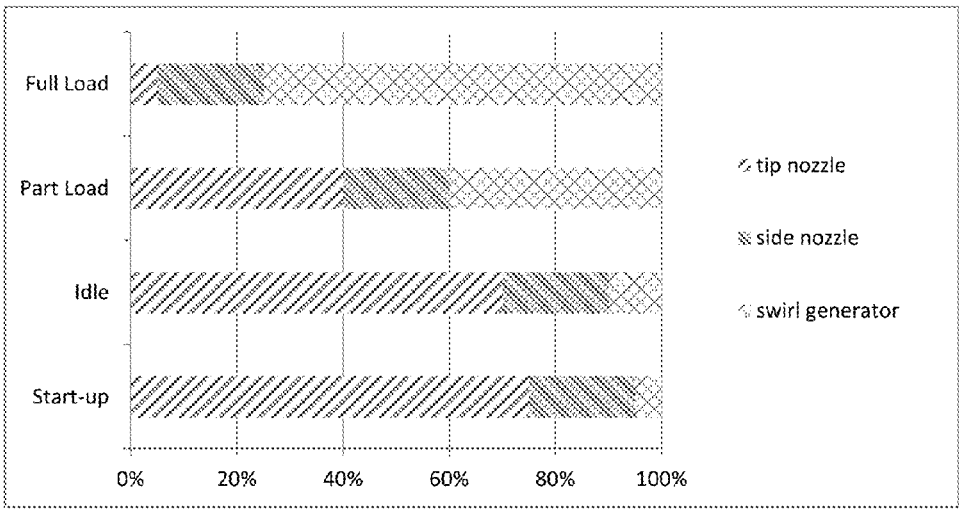
FIG. 15 shows an example of operation with gaseous fuel.

FIG. 13 shows operation of the burner 1 with gaseous fuel and side nozzles 11 inactive.

In this case operation occurs with three stages (i.e., the nozzles are divided in three groups independently operable).

A first stage is made of the tip nozzle 22 which supplies fuel in particular along the axis 10 of the burner, a second stage is made of the nozzles 6A at the conical swirl chamber 5 closer to the apex, and a third stage is made of the nozzles 6B at the conical swirl chamber farthest from the apex.

Figure 11:
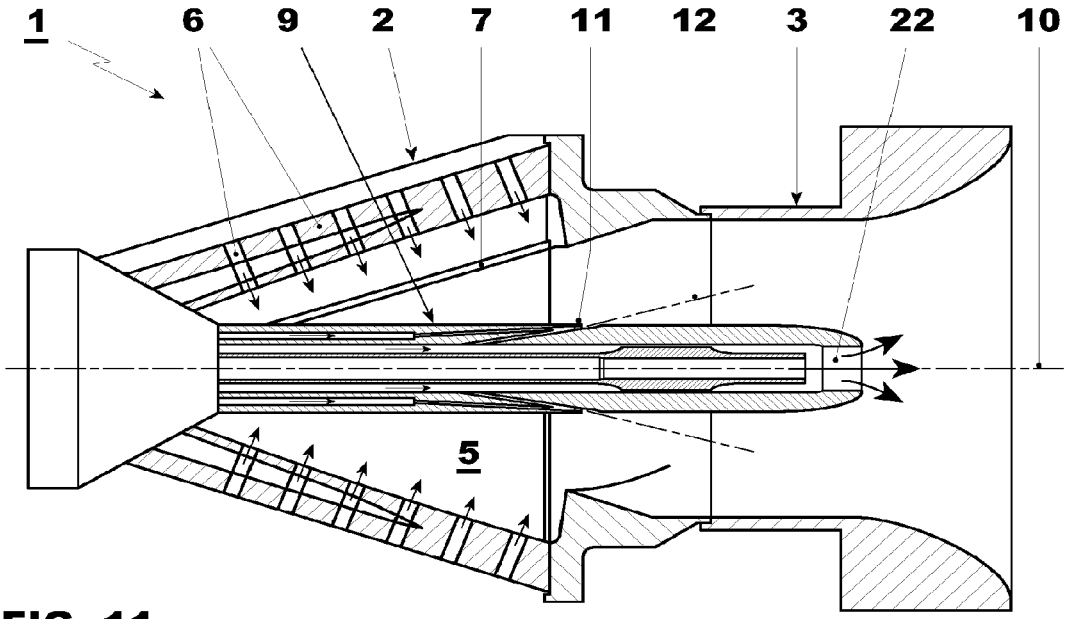
FIG. 11 shows a schematic view of the embodiment of the burner of FIG. 9 in a gas operation phase with staged mixing.

FIG. 11 shows the operation of the burner with gaseous fuel and the side nozzles 11 of the lance active.

Also in this case operation occurs with three stages; the first stage is made of the tip nozzle 22 which supplies fuel in particular along the axis 10 of the burner, the second stage is made of the nozzles 6 at the conical swirl chamber 5, and the third stage is made of the side nozzles 11 of the lance 9 which supply fuel in particular at the annular region about the axis 10 of the burner.

Also in this case, the gaseous fuel injected by the side nozzles 11 is dragged away by the air flow towards the annular periphery of the swirl chamber 5 and mixing tube 3. This allows an optimized mixing of fuel with air to be obtained, so reducing the extinction temperature problems of the flame, NOx emissions and pulsation in particular at starting and part load.

In addition, as the gaseous fuel intended for the peripheral portion of the swirl generator 2 and mixing tube 3 is injected from both the nozzles 6 and the nozzles 11, the amount of gaseous fuel injected from the nozzles 6 is less than that needed in traditional burners (i.e. burners with lance without side nozzles 11).

For this reason the burner of the invention may inject less gaseous fuel from the nozzles 6 of the swirl generator 2 than the traditional burners. This permits burners embodying principles of the present invention to have smaller and cheaper compressors for the gaseous fuel than traditional burners.

For example:

at starting, 70-80% of the gaseous fuel is injected through the tip nozzle 22, 20% is injected through the side nozzles 11, and 0-10% is injected through the nozzles at the swirl generator;

at idle operation, 70% of the gaseous fuel is injected through the tip nozzle 22, 20% is injected through the side nozzles 11, and 10% is injected through the nozzles at the swirl generator;

at part load, 40% of the gaseous fuel is injected through the tip nozzle 22, 20% is injected through the side nozzles 11, and 40% is injected through the nozzles at the swirl generator;

at full load, 5% of the gaseous fuel is injected through the tip nozzle 22, 20% is injected through the side nozzles 11, and 75% is injected through the nozzles at the swirl generator.

Figure 12:
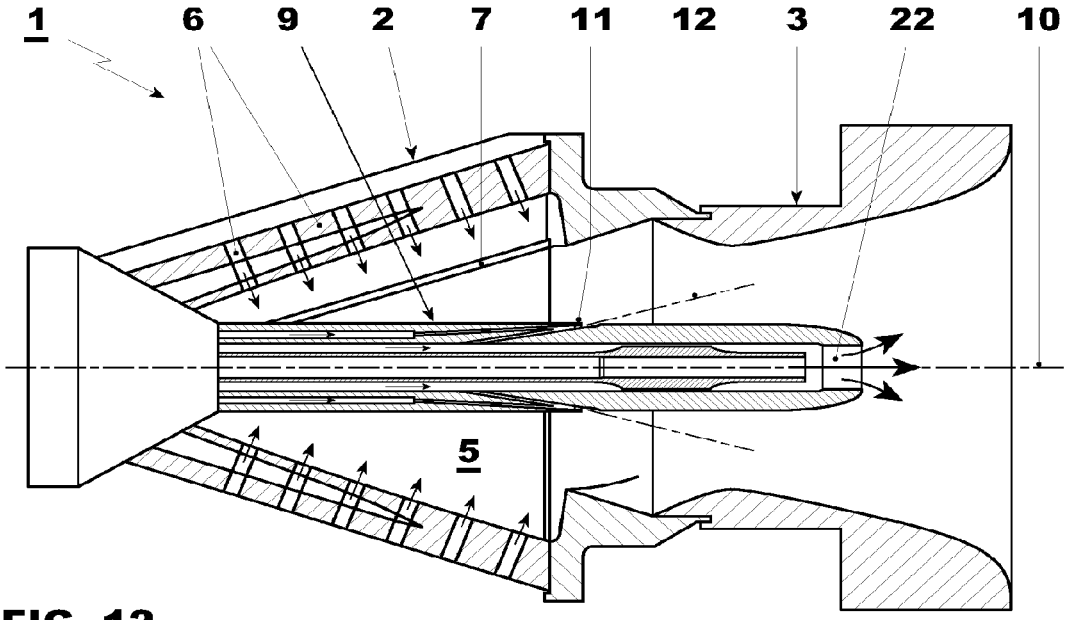
FIG. 12 shows a schematic view of the embodiment of the burner of FIG. 10 in a gas operation phase with staged mixing.

The operation of the burner of FIG. 12 is the same as that already described with reference to FIG. 11; in addition, in this embodiment the contraction 35 increases the velocity of the air flow after fuel injection in order to reduce flashback risks.

The burner conceived in this manner is susceptible to numerous modifications and variants, all falling within the scope of the claims.

In practice the materials used and the dimensions can be chosen at will according to requirements and to the state of the art.

REFERENCE NUMBERS

1 burner
2 swirl generator
3 mixing tube
5 swirl chamber
6 nozzles
6A first group of nozzles
6B second group of nozzles
7 apertures
9 lance
10 longitudinal axis of the swirl generator
11 side nozzles
12 axes of the side nozzles
15 annular lid
16 body of the lance
17 annular slit
20 protrusion
22 tip nozzle
25 first pipe
26 second pipes
27 pipe for supplying ah⁻
30 inlet diffusion zone
31 intermediate cylindrical zone
32 outlet zone
33 end diffusion portion
35 contraction While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A method for operating a burner having a swirl generator defined by at least two walls facing one another to define a substantially conical swirl chamber, the swirl generator including swirl generator nozzles arranged to inject fuel and apertures arranged to feed an oxidizer into said swirl chamber, a mixing tube positioned downstream of the swirl generator, and a lance positioned inside at least the swirl generator, the lance extending along a longitudinal axis of the swirl generator and being provided with lance side nozzles for ejecting gaseous fuel within the burner, the lance side nozzles having axes inclined with respect to an axis of the lance, wherein the lance includes one of an annular protrusion extending from and encircling an outer surface of a body of the lance or an inner surface of a lid encircling the body of the lance, the method comprising:

at starting, injecting about 70-80% of the gaseous fuel through the lance tip nozzle, injecting about 20% through the lance side nozzles, and injecting about 0-10% of the gaseous fuel through the swirl generator nozzles;

at idle operation, injecting about 70% of the gaseous fuel through the lance tip nozzle, injecting about 20% of the gaseous fuel through the lance side nozzles, and injecting about 10% of the gaseous fuel through the swirl generator nozzles;

at part load, injecting about 40% of the gaseous fuel through the lance tip nozzle, injecting about 20% of the gaseous fuel through the lance side nozzles, and injecting about 40% of the gaseous fuel through the swirl generator nozzles; and at full load, injecting about 5% of the gaseous fuel through the lance tip nozzle, injecting about 20% of the gaseous fuel through the lance side nozzles, and injecting about 75% of the gaseous fuel through the swirl generator nozzles;

wherein the gaseous fuel injected through the lance side nozzles is injected against the one of the annular protrusion or the inner surface of the lid as the gaseous fuel exits the lance side nozzles.

2. The method of claim 1, wherein the gaseous fuel is injected against the inner surface of the lid as the gaseous fuel exits the lance side nozzles, and the lance side nozzles are disposed at an acute angle with respect to the axis of the lance.

3. The method of claim 1, wherein the gaseous fuel is injected against the annular protrusion as the gaseous fuel exits the lance side nozzles, and the lance side nozzles are disposed at an acute angle with respect to the axis of the lance.

4. A method for operating a burner having a swirl generator defined by at least two walls facing one another to define a substantially conical swirl chamber, the swirl generator including swirl generator nozzles arranged to inject fuel and apertures arranged to feed an oxidizer into said swirl chamber, a mixing tube positioned downstream of the swirl generator, and a lance positioned inside at least the swirl generator, the lance extending along a longitudinal axis of the swirl generator and being provided with lance side nozzles for ejecting fuel within the burner, the lance side nozzles having axes inclined with respect to an axis of the lance, wherein the lance includes an annular protrusion extending from and encircling an outer surface of a body of the lance, the method comprising:

during operation with oil fuel:

at starting, injecting about 80% of the oil fuel through a lance tip nozzle and injecting about 20% of the oil fuel through the lance side nozzles;

at idle operation, injecting about 75% of the oil fuel through the lance tip nozzle and injecting about 25% of the oil fuel through the lance side nozzles;

at part load, injecting about 50% of the oil fuel through the lance tip nozzle and injecting about 50% of the oil fuel through the lance side nozzles;

at full load, injecting about 10% of the oil fuel through the lance tip nozzle and injecting about 90% of the oil fuel through the lance side nozzles; and, wherein the oil fuel injected through the lance side nozzles is injected against the annular protrusion as the oil fuel exits the lance side nozzles; and, during operation with gaseous fuel:

at starting, injecting about 70-80% of the gaseous fuel through the lance tip nozzle, injecting about 20% of the gaseous fuel through the lance side nozzles, and injecting about 0-10% of the gaseous fuel through the swirl generator nozzles;

at idle operation, injecting about 70% of the gaseous fuel through the lance tip nozzle, injecting about 20% of the gaseous fuel through the lance side nozzles, and injecting about 10% of the gaseous fuel through the swirl generator nozzles;

at part load, injecting about 40% of the gaseous fuel through the lance tip nozzle, injecting about 20% of the gaseous fuel through the lance side nozzles, and injecting about 40% of the gaseous fuel through the swirl generator nozzles; and at full load, injecting about 5% of the gaseous fuel through the lance tip nozzle, injecting about 20% of the gaseous fuel through the lance side nozzles, and injecting about 15% of the gaseous fuel through the swirl generator nozzles;

wherein the gaseous fuel injected through the lance side nozzles is injected against the annular protrusion as the gaseous fuel exits the lance side nozzles.

5. The method of claim 4, wherein the lance side nozzles are disposed at an acute angle with respect to the axis of the lance, the method comprising:

during the operation with oil fuel:

generating a cylindrical fuel film encircling the lance via the oil fuel injected from the lance side nozzles.

6. The method of claim 4, wherein the lance side nozzles are disposed at an acute angle with respect to the axis of the lance, the method comprising:

during the operation with oil fuel;

generating a discrete fuel film encircling the lance via the oil fuel injected from the lance side nozzles.

7. The method of claim 4, comprising:

during the operation with oil fuel:

injecting the oil fuel through the lance tip nozzle along an axis of the burner so that a cloud of fuel droplets is concentrated along the axis of the burner.

8. The method of claim 4, comprising:

during the operation with gaseous fuel:

dragging away the gaseous fuel injected by the lance side nozzles via air flow towards an annular periphery of the swirl chamber and the mixing tube.

9. A method for operating a burner having a swirl generator defined by at least two walls facing one another to define a substantially conical swirl chamber, the swirl generator including swirl generator nozzles arranged to inject fuel and apertures arranged to feed an oxidizer into said swirl chamber, a mixing tube positioned downstream of the swirl generator, and a lance positioned inside at least the swirl generator, the lance extending along a longitudinal axis of the swirl generator and being provided with lance side nozzles for ejecting fuel within the burner, the lance side nozzles having axes inclined with respect to an axis of the lance, wherein the lance includes an inner surface of a lid encircling a body of the lance, and the lance side nozzles are disposed at an acute angle with respect to the longitudinal axis of the lance, the method comprising:

during operation with oil fuel:

at starting, injecting about 80% of the oil fuel through a lance tip nozzle and injecting about 20% of the oil fuel through the lance side nozzles;

at idle operation, injecting about 75% of the oil fuel through the lance tip nozzle and injecting about 25% of the oil fuel through the lance side nozzles;

at part load, injecting about 50% of the oil fuel through the lance tip nozzle and injecting about 50% of the oil fuel through the lance side nozzles;

at full load, injecting about 10% of the oil fuel through the lance tip nozzle and injecting about 90% of the oil fuel through the lance side nozzles; and, generating a cylindrical fuel film encircling the lance via the oil fuel injected from the lance side nozzles;

wherein the oil fuel injected through the lance side nozzles is injected against the inner surface of the lid; and, during operation with gaseous fuel:

at starting, injecting about 70-80% of the gaseous fuel through the lance tip nozzle, injecting about 20% of the gaseous fuel through the lance side nozzles, and injecting about 0-10% of the gaseous fuel through the swirl generator nozzles;

at idle operation, injecting about 70% of the gaseous fuel through the lance tip nozzle, injecting about 20% of the gaseous fuel through the lance side nozzles, and injecting about 10% of the gaseous fuel through the swirl generator nozzles;

at part load, injecting about 40% of the gaseous fuel through the lance tip nozzle, injecting about 20% of the gaseous fuel through the lance side nozzles, and injecting about 40% of the gaseous fuel through the swirl generator nozzles; and at full load, injecting about 5% of the gaseous fuel through the lance tip nozzle, injecting about 20% of the gaseous fuel through the lance side nozzles, and injecting about 15% of the gaseous fuel through the swirl generator nozzles;

wherein the gaseous fuel injected through the lance side nozzles is injected against the inner surface of the lid.

* * * * *